US007510224B2

(12) United States Patent
Bacco et al.

(10) Patent No.: US 7,510,224 B2
(45) Date of Patent: Mar. 31, 2009

(54) RELEASABLE TRAILER DOOR LOCK

(75) Inventors: Paul Bacco, Phoenix, AZ (US); David Bosch, Phoenix, AZ (US); Richard H. Stout, Apache Junction, AZ (US); Dean Leo Jacobson, Tempe, AZ (US)

(73) Assignee: Southwest Mobile Storage, Inc., Phoenix, AZ (US)

( * ) Notice: Subject to any disclaimer, the term of this patent is extended or adjusted under 35 U.S.C. 154(b) by 0 days.

(21) Appl. No.: 11/626,700

(22) Filed: Jan. 24, 2007

(65) Prior Publication Data

US 2007/0200362 A1 Aug. 30, 2007

Related U.S. Application Data

(60) Provisional application No. 60/743,282, filed on Feb. 13, 2006.

(51) Int. Cl.
*E05B 15/02* (2006.01)

(52) U.S. Cl. ..... 292/340; 292/DIG. 65; 292/DIG. 32

(58) Field of Classification Search ..... 292/340, 292/341, 92, 93, DIG. 65, DIG. 32
See application file for complete search history.

(56) References Cited

U.S. PATENT DOCUMENTS

| | | | | |
|---|---|---|---|---|
| 2,089,163 | A | 8/1937 | Hansen | |
| 2,461,426 | A * | 2/1949 | King | 292/340 |
| 2,618,498 | A | 11/1952 | Schlesser | |
| 3,099,473 | A * | 7/1963 | Pastva, Jr. | 292/240 |
| 3,134,618 | A * | 5/1964 | Heimann | 292/240 |
| 3,346,288 | A | 10/1967 | Cosentino | |
| 3,352,585 | A * | 11/1967 | Crosswell et al. | 292/92 |
| 3,614,147 | A * | 10/1971 | Spector | 292/254 |
| 3,871,694 | A * | 3/1975 | White | 292/92 |
| 4,530,532 | A | 7/1985 | Fujiya | |
| 4,598,941 | A * | 7/1986 | Nelson | 292/134 |
| 6,427,500 | B1 * | 8/2002 | Weinerman et al. | 70/135 |
| 6,959,846 | B2 * | 11/2005 | Schomaker et al. | 224/404 |
| 2003/0047949 | A1 * | 3/2003 | Brunner | 292/163 |

FOREIGN PATENT DOCUMENTS

| | | |
|---|---|---|
| DE | 10143640 | 1/2003 |
| GB | 1490651 | 11/1977 |
| GB | 2275733 | 9/1994 |

OTHER PUBLICATIONS

International Search Report and Written Opinion dated Oct. 8, 2007.
International Preliminary Report on Patentability dated Jun. 18, 2008.

* cited by examiner

*Primary Examiner*—Gary Estremsky
(74) *Attorney, Agent, or Firm*—Snell & Wilmer L.L.P.

(57) ABSTRACT

A system of locking a door is disclosed. The system according to the present invention comprises a releasable keeper that secures a door locking mechanism to keep a door secured to an enclosure in a locked position. A release mechanism that is operated from the interior of the enclosure releases the releasable keeper from the enclosure and enable the door to be opened and prevents people from becoming trapped within the enclosure by a locked door. In an exemplary embodiment, the release mechanism is operated by a lever that operates a pulley system to disengage the release mechanism from the releasable keeper.

20 Claims, 11 Drawing Sheets

RELEASABLE TRAILER DOOR LOCK

CROSS REFERENCE TO RELATED APPLICATION

This Application claims priority to and the benefit of U.S. Provisional Patent Application No. 60/743,282 which was filed on Feb. 13, 2006 and entitled "Trailer Escape/Container Keeper/Cam Release System" wherein such application is incorporated in its entirety by reference.

FIELD OF INVENTION

This invention relates generally to methods and apparatuses for providing egress from trailers, containers, box vans, large storage lockers, garages, semi-trailers, reefers, cargo trailers, dry van trailers and the like, and particularly to methods of modifying trailers, and the like, to comprise an internal release system that allows an externally-locked trailer door to be opened from the inside, thereby permitting egress.

BACKGROUND OF THE INVENTION

Trailers for transporting and storing goods are generally known. Such trailers typically have at least one door that provides access to the interior of the trailer and facilitates loading and unloading of goods within. Trailer doors are usually secured via an external locking mechanism. External locking mechanisms, such as locking rods, padlocks, crossbars, and the like are known. For example, locking rod/cam mechanisms are known and may be secured vertically on the exterior of a trailer door via guide brackets that are bolted to the door. The locking rod/cam may be secured such that when the door handle is in the closed position, the locking rod/cam may be seated into a keeper that is typically secured to the body of the trailer, thus locking the door. Likewise, when the door handle is lifted and rotated away from the door, the locking rod/cam is released from the keeper thereby allowing the door to open.

Such external locking mechanisms generally prevent the doors from opening unintentionally. However, one disadvantage of such external locking mechanisms is that they cannot be activated by a person inside the trailer, thereby trapping the person inside. In this regard, hundreds of people every year become trapped inside trailers in the United States alone.

Moreover, this problem may be more prevalent in the case of trailers used to transport goods long-distance, such as semi-trailers. For example, due to their size, it may take several people working simultaneously to load the trailer, thereby increasing the likelihood that a worker may become trapped inside when the semi-trailer is sealed with an external locking mechanism. Not only may workers become trapped inside, but stowaways and children may also become trapped. More nefariously, trailers with external locking mechanisms may be used to trap and smuggle humans throughout the United States. Entrapment in a semi-trailer that is being transported cross-country may be especially dangerous because the semi-trailer may not be opened during transit. This long period of transit may increase the possibility that a person trapped inside will not survive.

Accordingly, there is a need for an invention that, among other benefits, (1) provides a route of quick egress from a trailer if a human becomes trapped inside; (2) does not permit unauthorized external access to the locked trailer; and (3) may be inexpensively installed on existing trailers.

SUMMARY OF THE INVENTION

While the way that the present invention overcomes the disadvantages of the known art will be discussed in greater detail below, in general, the present invention simultaneously provides a route of egress from a trailer while preventing unauthorized exterior access. Preliminarily, the present invention is described herein largely in connection with trailers, particularly, semi-trailers. However, one skilled in the art will appreciate that in the context of the present invention, numerous containers/units, such as dry van trailers, containers, box vans, semi-trailers, reefers, large storage lockers, garages, cargo trailers or anything capable of enclosing and/or trapping a person inside may fall within the scope of the present invention.

In an exemplary embodiment of the present invention, the trailer is equipped with a release system that permits the doors of a trailer or other enclosure from being unlocked and opened by a person within the trailer or other enclosure. In an exemplary embodiment, the trailer or other enclosure is equipped with a releasable lock such as a keeper/cam release device that permits a keeper of a locking rod/cam mechanism to be opened or disengaged from the body of a trailer, thus permitting egress from the interior of the trailer.

An exemplary releasable lock such as a keeper/cam release system comprises two keeper/cam release mechanisms, two release cables, two pulley/guide mechanisms, a release device, and two releasable keepers. The keeper/cam release mechanisms each have a lock pin that has one end secured to a release cable and the other end inserted into a releasable keeper. The release cable is then guided by the pulley/guide mechanism to the release device that is typically a lever. When the lever is activated, tension in the release cable is increased and the lock pin is retracted from the releasable keeper permitting the releasable keeper to open on a hinge or to completely disengage from the body of the trailer, thus permitting egress by allowing the opening of the trailer door.

BRIEF DESCRIPTION OF THE DRAWINGS

A more complete understanding of the present invention may be derived by referring to the detailed description in connection with the Figures.

DETAILED DESCRIPTION

Figure 1:
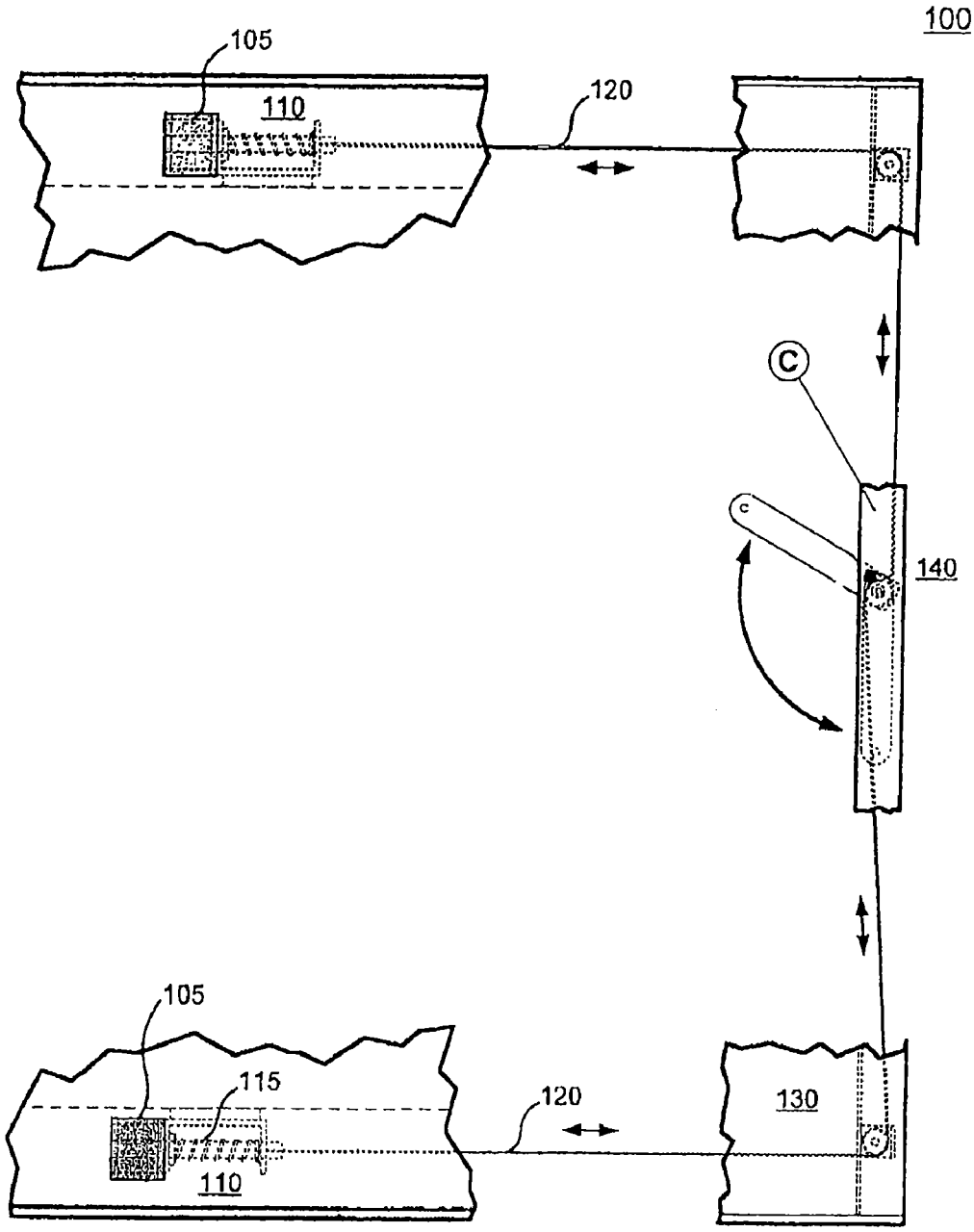
FIG. 1 depicts an internal perspective view of an exemplary embodiment of a keeper/cam release system.

The detailed description of exemplary embodiments of the invention herein makes reference to the accompanying figures, which show the exemplary embodiment by way of illustration. While these exemplary embodiments are described in sufficient detail to enable one skilled in the art to practice the invention, it should be understood that other embodiments may be realized, and that changes may be made without departing from the spirit and scope of the invention. Thus, the detailed description herein is presented for purposes of illustration only and not by way of limitation.

For the sake of brevity, functional embodiments of the apparatus and systems (and components of the individual operating components of the systems) may not be described in detail herein. Furthermore, the connecting lines shown in the various figures contained herein are intended to represent exemplary functional relationships and/or physical connections between the various elements. It should be noted that many alternative or additional functional relationships or physical connections may be present in a practical system.

In accordance now with an exemplary embodiment of the present invention, an enclosure, such as a trailer, may be equipped with a releasable door lock that secures one or more doors in a locked position. A releasable door lock is any lock or system that permits a person who is located in the interior of a locked enclosure (such as a trailer) to unlock and open the enclosure's doors and allow egress from the enclosure. An exemplary releasable door lock is a keeper/cam release system. In an exemplary, non-limiting embodiment, a keeper/cam release system may comprise a release mechanism, a release cable, a pulley/guide mechanism, a release lever, and a releasable keeper.

As shown in FIGS. 1-11, an exemplary embodiment of a releasable door lock 100 is a keeper/cam release system attached to a door of a trailer 150 where the releasable lock 100 comprises two release mechanisms 110 with two releasable keepers 105, two release cables 120, two pulley/guide mechanisms 130, and a release device 140. As used throughout this description, the term "keeper" is meant to denote any device that a locking mechanism is secured to. In one exemplary embodiment, releasable keeper 105 is a removable block that slidingly engages the body of a trailer 150. In another exemplary embodiment as discussed below, releasable keeper 105 comprises a two-piece keeper with pieces located on the interior and exterior of the trailer. In yet other exemplary embodiments, releasable keeper 105 can comprise slot mechanisms where cams slide into, removable panels, or any other assemblies that are meant to engage a locking rod and cam 170 or any other similar device configured to lock a door of a trailer or other enclosure.

Figure 3:
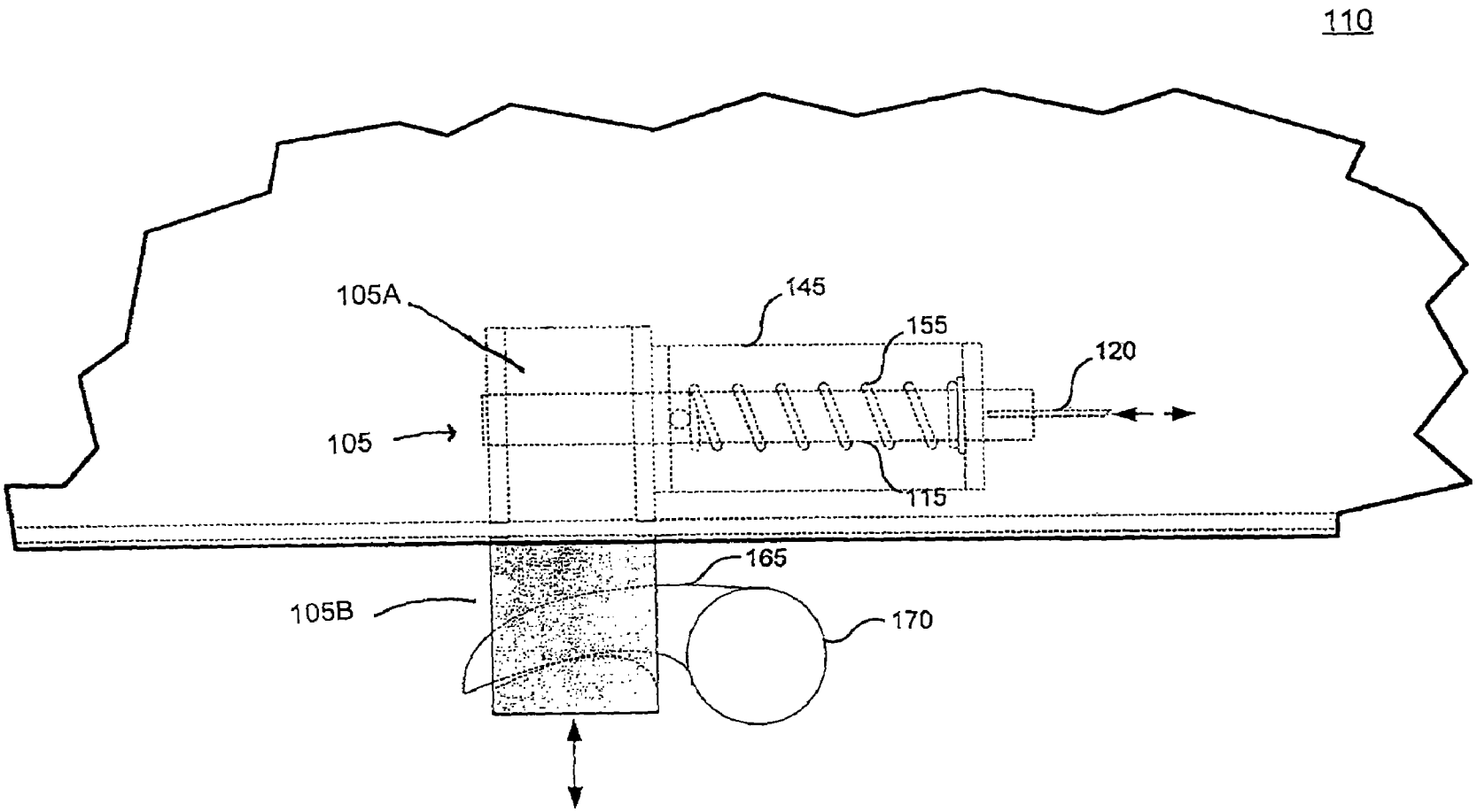
FIG. 3 depicts a top perspective view of an exemplary embodiment of a keeper/cam release mechanism, a releasable keeper, and a cam.
Figure 4:
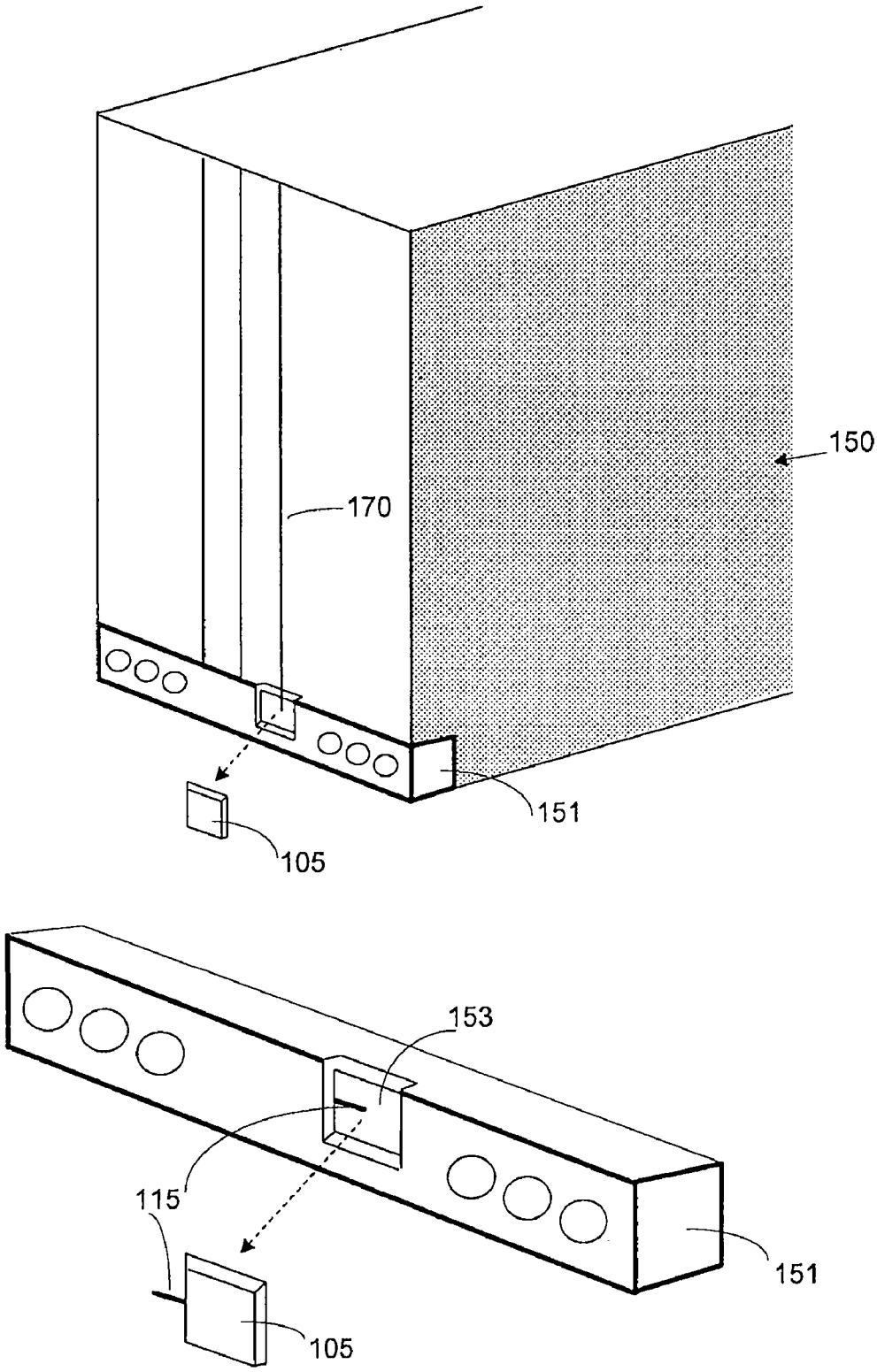
FIG. 4 depicts a rear exploded view of an exemplary embodiment of a locking mechanism and releasable keeper apart from the trailer body.
Figure 5:
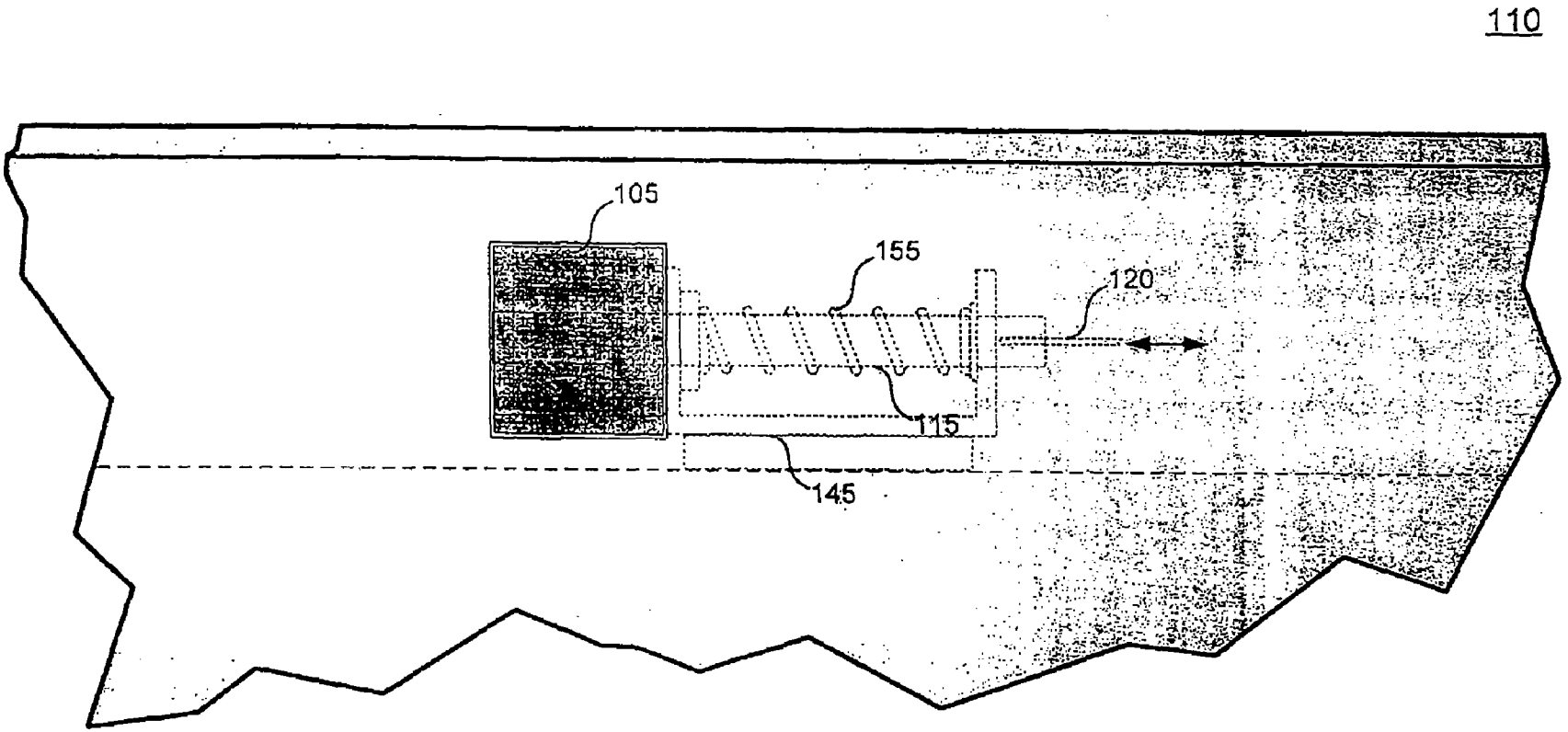
FIG. 5 depicts a rear perspective view of an exemplary embodiment of a keeper/cam release mechanism, and a releasable keeper.

The release mechanism 110 and releasable keeper 105 are shown in more detail in FIGS. 3-5. In an exemplary embodiment, each release mechanism 110 is a keeper/cam release mechanism that has a keeper lock pin 115 oriented substantially horizontally. In other exemplary embodiments, release mechanism 110 and releasable keeper 105 are oriented in other ways, such as vertically or diagonally. In this respect, any orientation of release mechanism 110 and releasable keeper 105 that is capable of locking the doors of trailer 150 and permitting internal release of the locking mechanism from the interior of trailer 150 falls within the scope of the present invention.

In this exemplary embodiment, lock pin 115 may have one end secured to release cable 120 and another end that inserts into an aperture defined by releasable keeper 105. The release cable 120 may be guided by pulley/guide mechanism 130 that connects release device 140 to release mechanism 110. When release device 140 is activated, tension in release cable 120 may be increased which retracts lock pin 115 from releasable keeper 105 which permits releasable keeper 105 to disengage from the body of trailer 150 and enables the door of trailer 150 to be opened because it is in an unlocked position.

Figure 2:
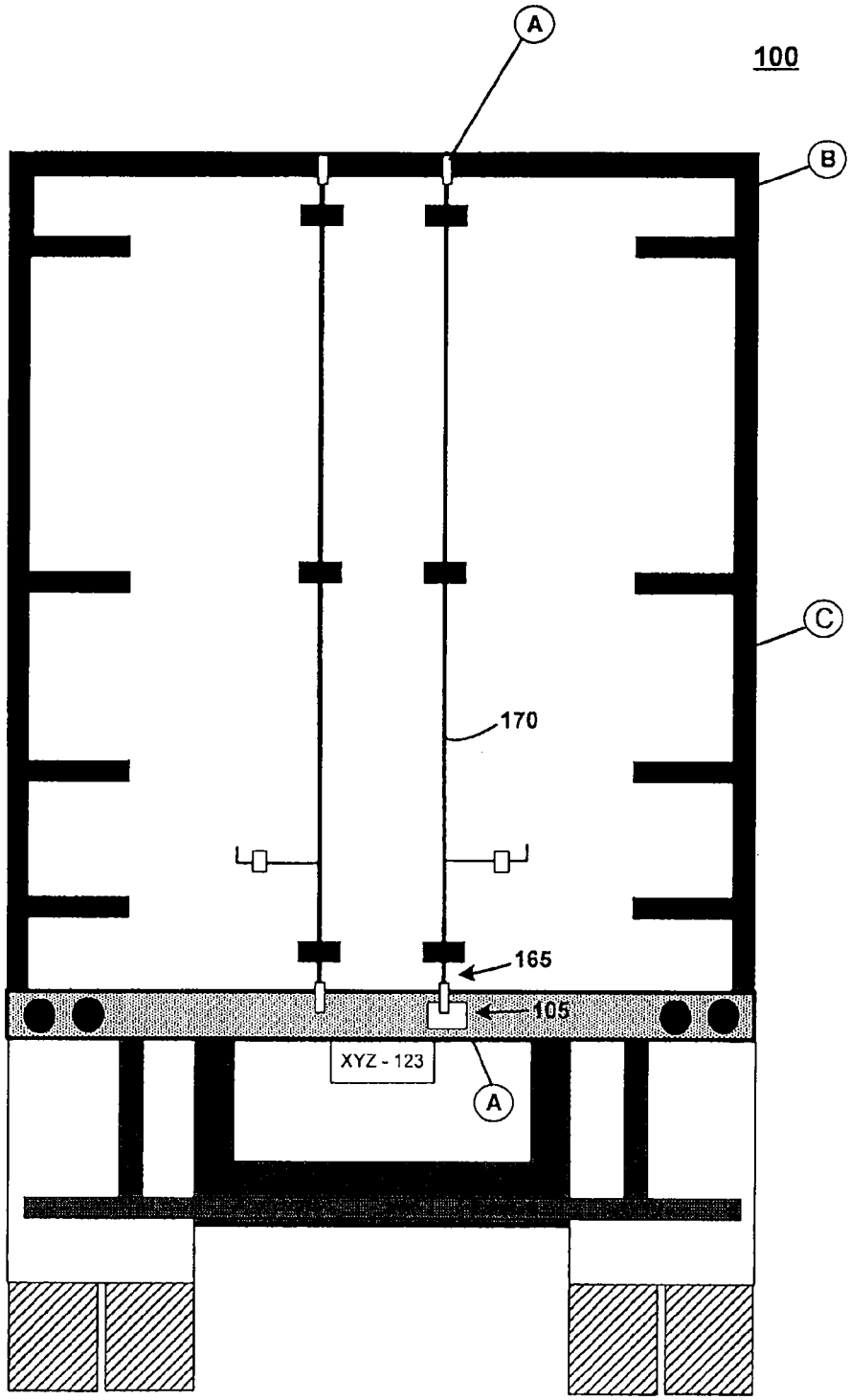
FIG. 2 depicts an external perspective view of an exemplary embodiment of the releasable lock attached to the rear of a trailer.

An exemplary embodiment of a trailer 150 comprises two releasable door locks 100 at locations A, two pulley/guide mechanisms at locations B, and release device 140 at location C. FIG. 2 also depicts an exemplary embodiment of an existing locking rod/cam mechanism 170 in which a cam 165 of locking rod/cam mechanism 170 may be seated into releasable keeper 105 by rotating a locking rod handle, thus externally locking doors of trailer 150.

FIG. 4 depicts one exemplary embodiment of releasable keeper 105 and its relationship to trailer 150 or another enclosure. In this exemplary embodiment, releasable keeper 105 may be secured to the body of trailer 150 by slidingly engaging a bumper 151 or other lower, rear portion of trailer 150. Releasable keeper 105 may be a removable block that engages an aperture 153 defined by the body of trailer 150. In another exemplary embodiment, releasable keeper 105 is attached to one or more flanges or projections that protrude from trailer 150 or other enclosure.

Release mechanism 110 and lock pin 115 secure releasable keeper 105 to trailer 150 by lock pin 115 engaging an aperture (not shown) in the side of releasable keeper 105. When engaged, lock pin 115 may be seated within releasable keeper 105 and releasable keeper 105 is secured to trailer 150. Thus, cam 165 can attach to releasable keeper 105 and keep the doors of trailer 150 in a locked position.

When pressure to lock pin 115 is removed and lock pin 115 may be removed from releasable keeper 105, releasable keeper 105 is configured to slide out of the body of the trailer 150. Then, simply applying pressure to the doors of the trailer 150 will force them into the open position because releasable keeper 105 is no longer secured to trailer 150. Since releasable keeper 105 is no longer secured to trailer 150, locking rod/cam mechanism 170 can be disengaged from releasable keeper 105 and the doors of trailer 150 opened by a person trapped inside.

In another exemplary embodiment, releasable keeper 105 is attached to an enclosure such as trailer 150 by hinges or another mechanism that enables releasable keeper 105 to swing outward to free the locking mechanism from releasable keeper 105. In this regard, the term "release" as used throughout, is meant to encompass not only releasable keeper 105 being completely disengaged from trailer 150, but being placed in any state whereby the locking mechanism such as locking rod/cam mechanism 170 and/or a cam 165 can be disengaged from releasable keeper 165. In yet another embodiment, releasable keeper 105 comprises a body that is completely secured to trailer 150 and has a door attached to the body. When releasable keeper 105 is released, the door is opened which enables cam 165 or any other locking mechanism to be disengaged from releasable keeper 105.

FIGS. 3 and 5 depict another exemplary embodiment of releasable lock 100. In this exemplary embodiment, release mechanism 110 may be releasably coupled to a two-piece releasable keeper 105 that comprises an internal keeper 105A located on the interior of trailer 150 and an external keeper 105B located on the exterior of trailer 150. Cam 165 of a locking rod/cam mechanism 170 may be seated into external keeper 105B to lock the doors. Internal keeper 105A may be releasably connected to external keeper 105B through holes (not shown) in the wall of trailer 150.

Internal keeper 105A can be connected to external keeper 105B by any known releasable mechanisms comprising, but not limited to hooks, bolts, pegs, screws, or a tongue and groove connection. When release mechanism 110 is operated as described below and releases internal keeper 105A on the interior of the trailer, external keeper 105B may also released because it is releasably connected to internal keeper 105A. When external keeper 105B is in a released state, cam 165 can be easily disengaged from external keeper 105B and the door can opened by a person located within the trailer by the person simply pushing on the door.

In an exemplary embodiment, release mechanism 110 comprises a lock pin holder 145 having lock pin 115 and a lock pin return spring 155. In other exemplary embodiments, other devices can be used that are configured to apply force on lock pin 115 and keep it engaged to releasable keeper 105. Other exemplary devices include pneumatic pins, or pins with other spring loaded arrangements such as placing a spring behind lock pin 115 to place pressure on lock pin 115 to keep it engaged within releasable keeper 105. The lock pin holder 145 may be secured to trailer 150 by any known or hereinafter devised means, such as screws, bolts, welding and the like. In an exemplary embodiment, lock pin holder 145 has guides which allow lock pin 115 to slide within lock pin holder 145. In this exemplary embodiment, lock pin 115 further comprises a lock pin return spring 155 coiled around its exterior that is configured to maintain lock pin 115 seated in releasable keeper 105 until release of releasable keeper 105 is desired. In other exemplary embodiments, another pressure applicator besides a spring may be used to apply pressure to lock pin 115. Other exemplary pressure applicators comprise, but are not limited to, pneumatic devices, electric systems, hydraulic devices, magnetic devices, or any other device now know or conceived in the future configured to seat lock pin 115 within releasable keeper 105.

In this exemplary embodiment, lock pin 115 has a first end secured to release cable 120 and a second end that inserts into releasable keeper 105. Therefore, when release device 140 is activated, release cable 120 pulls lock pin 115 out of releasable keeper 105, creating tension on lock pin return spring 155 and disengaging releasable keeper 105 from trailer 150 which enables cam 165 to be easily disengaged from releasable keeper 105 and thereby permitting egress by allowing the trailer door to be opened.

Although FIGS. 3-5 depict certain exemplary embodiments of releasable keeper 105 and the use of release mechanism 110 to removably secure releasable keeper 105 to trailer 150, it will be appreciated by one skilled in the art any method of removably securing releasable keeper 105 to trailer 150 that is currently known or hereinafter devised, may be used. For example, in other embodiments, pawls, clamps, motor driven screws and the like may be used instead of lock pin 115 to removably secure releasable keeper 105 to trailer 150.

In an exemplary embodiment, a securing device such as a lanyard may be attached to releasable keeper 105 to prevent the releasable keeper 105 from falling to the ground after its release. In another exemplary embodiment, releasable keeper 105 may be attached to trailer 150 by hinges to prevent it from falling to the ground when released. Any other devices now known or developed in the future to secure releasable keeper 105 to trailer 150 can also be used and fall within the scope of the present invention.

Figure 6:
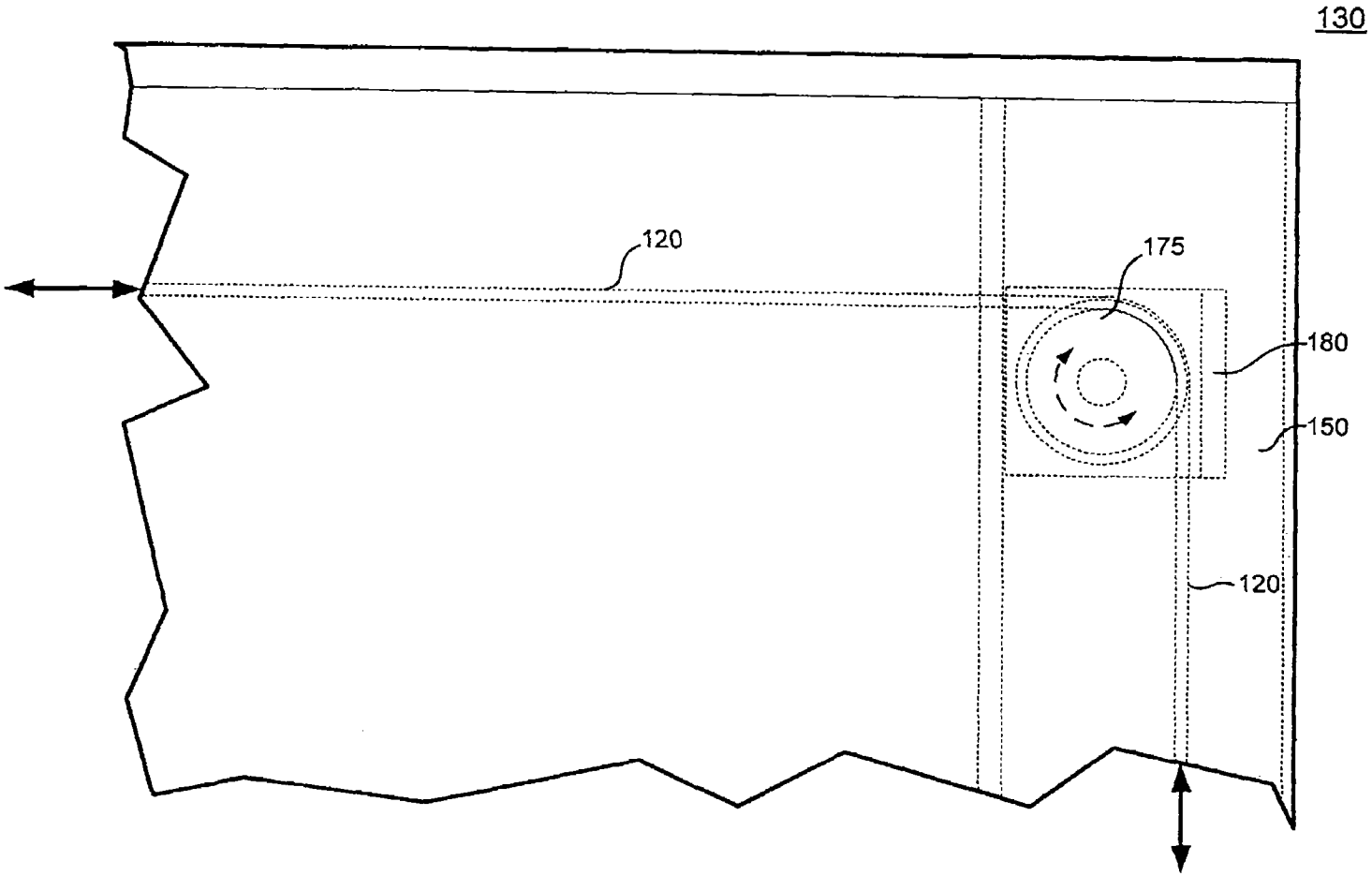
FIG. 6 depicts an external perspective rear view of an exemplary embodiment of a pulley/guide mechanism.
Figure 7:
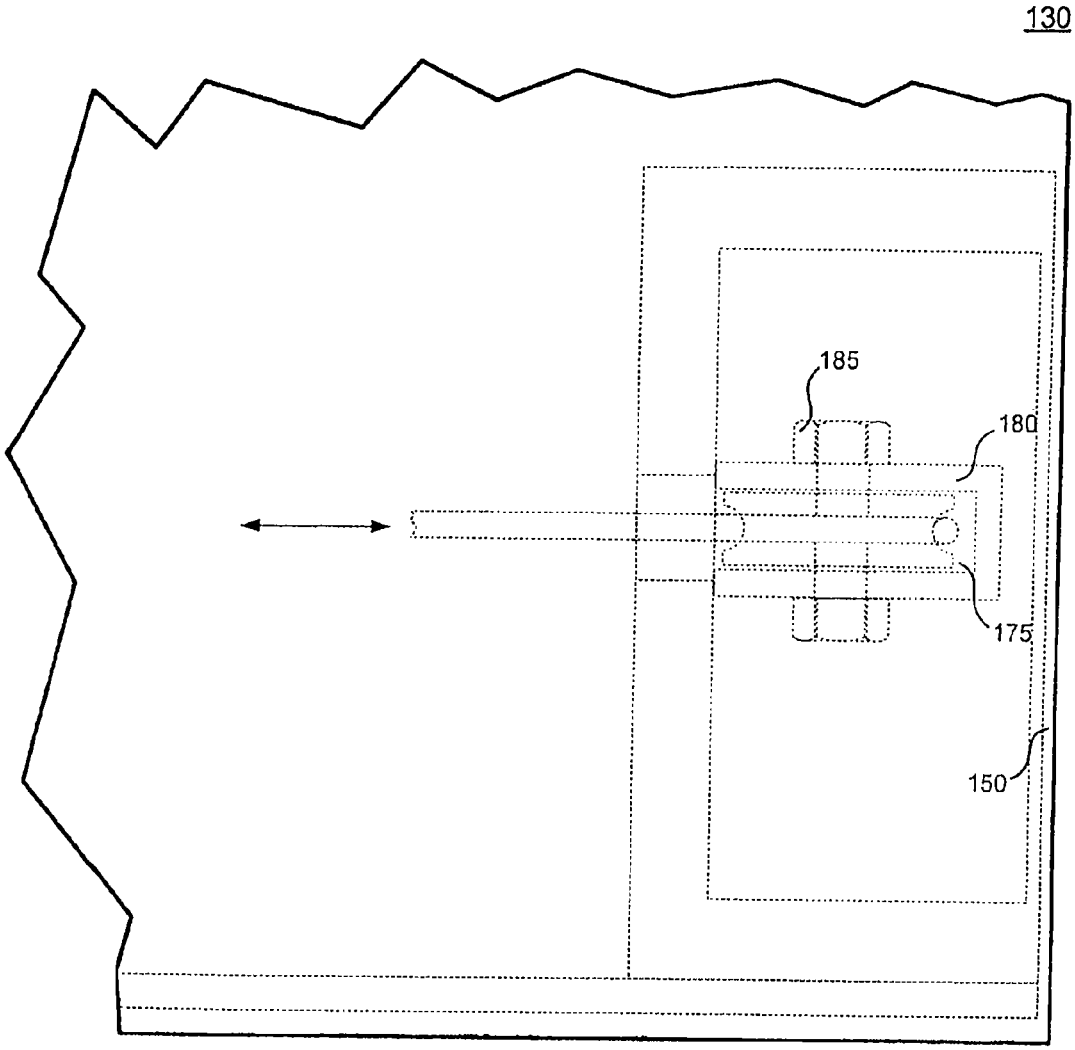
FIG. 7 depicts an external perspective top view of an exemplary embodiment of a pulley/guide mechanism.
Figure 8:
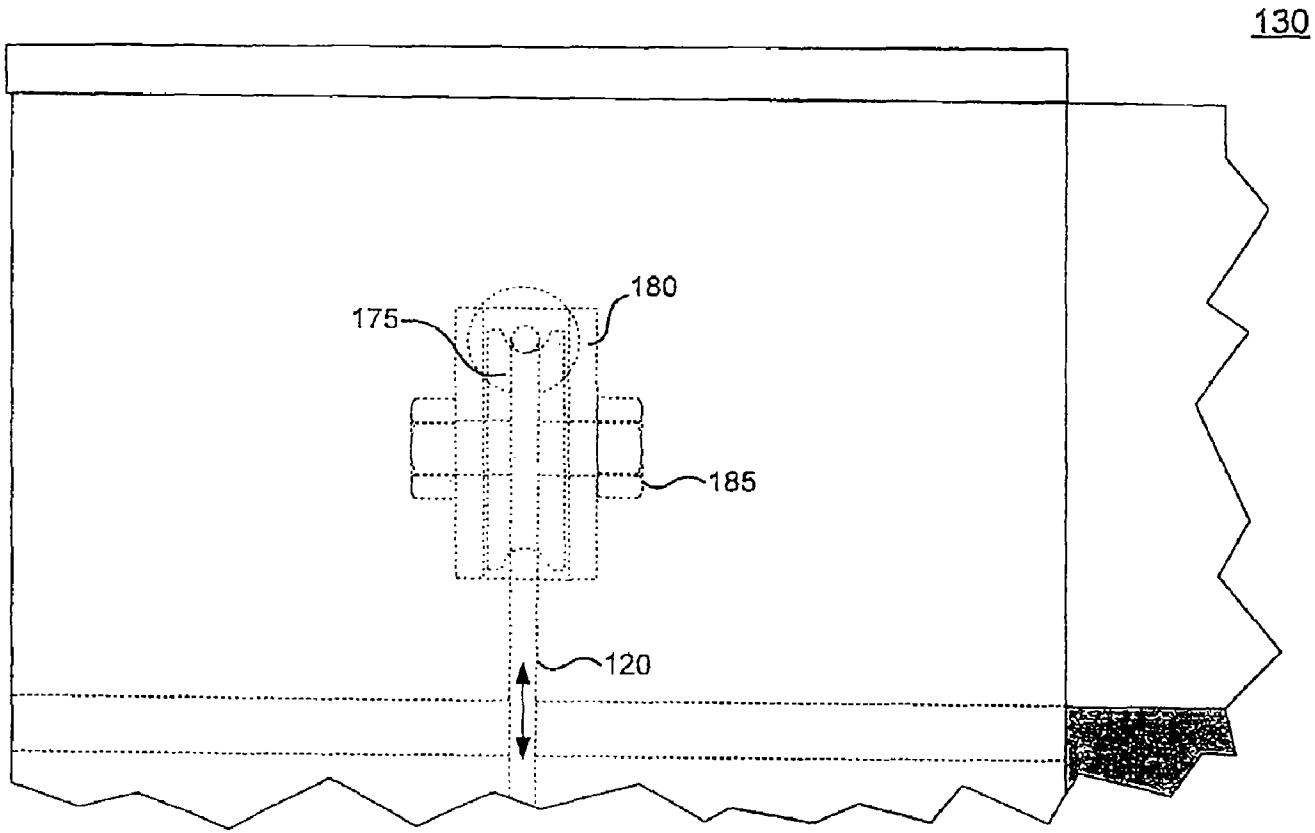
FIG. 8 depicts an external perspective side view of an exemplary embodiment of a pulley/guide mechanism.

With reference to FIGS. 6-8, an exemplary embodiment of a pulley system such as a pulley/guide mechanism 130 as illustrated which is configured to connect release device 140 to release mechanism 110. As shown, a pulley/guide mechanism 130 comprises a pulley 175 in a pulley support 180 using a hex bolt with a locking hex nut 185 securing pulley/guide mechanism 130 to the interior of the trailer 150. In one exemplary embodiment, pulley 175 comprises grooves around its circumference to seat and guide release cable 120. Thus, when release device 140 is activated, pulley 175 rotates and guides release cable 120. Although pulley 175 is shown in an exemplary embodiment in FIG. 8 as circular, it will be appreciated by one skilled in the art that pulley 175 may be configured in alternative sizes or shapes, (such as cam-shaped), suitable as may be desired to provide, for example, leverage, and to guide release cable 120. In an exemplary embodiment, release cable 120 is any conventional tensile wire cable, though any material that is strong enough to withstand the tension created by the pulley guide mechanism 130 may likewise be used.

In other exemplary embodiments, other devices that are configured to connect release device 140 to release mechanism 110 and allow a user to operate release mechanism 110 may be used and fall within the scope of the present invention. Certain other exemplary devices besides pulley/guide mechanism 130 and release cable 120 that can be used comprise, but are not limited to, ropes, levers, or any other device that enables release device 140 to control release mechanism 110. In other exemplary embodiments, release device 140 is electronically connected to release mechanism 110 by wires. In this exemplary embodiment, release mechanism 110 is electronically operated and further comprises a power supply such as one or more batteries.

In yet other exemplary embodiments, release mechanism 110 and release device 140 are not physically connected but communicate wirelessly through radio frequency signals or other wireless communication mediums, standards, or protocols. Certain exemplary standards include the WiFi and Bluetooth protocol. In these exemplary embodiments, release mechanism 110 is also electronically operated.

Figure 9:
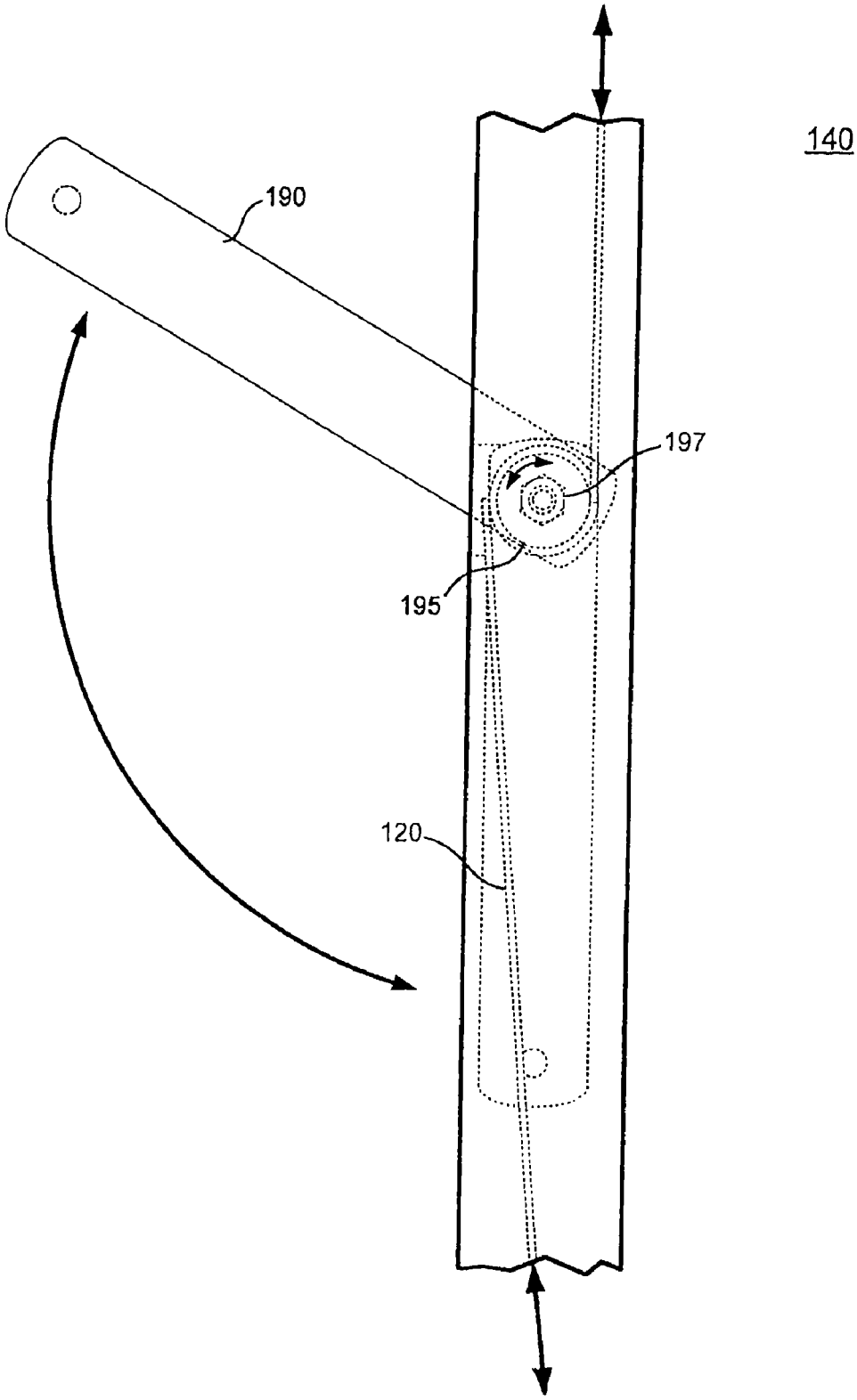
FIG. 9 depicts a rear view of an exemplary embodiment of a keeper/cam release lever.
Figure 10:
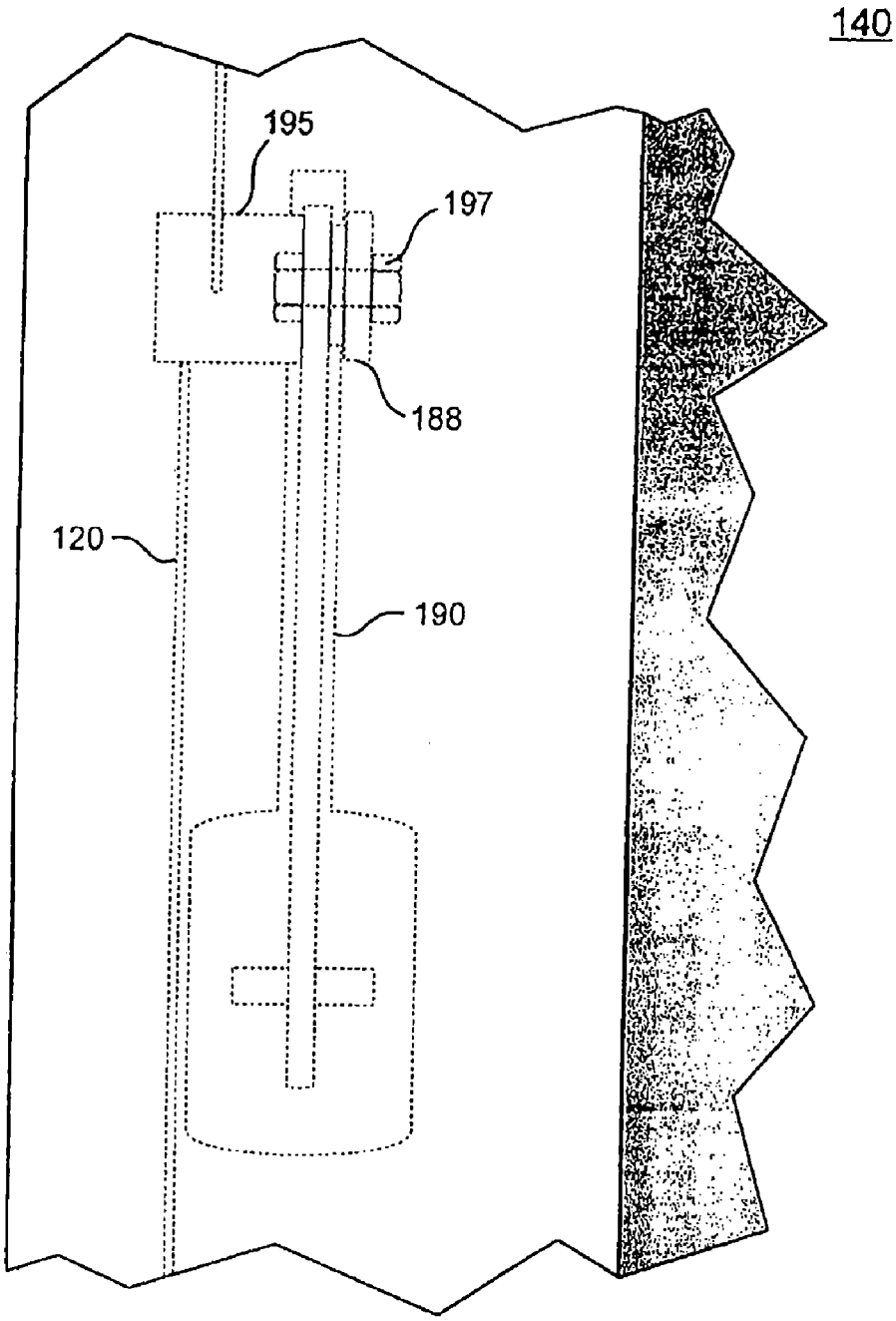
FIG. 10 depicts a right side perspective view of an exemplary embodiment of keeper/cam release lever.
Figure 11:
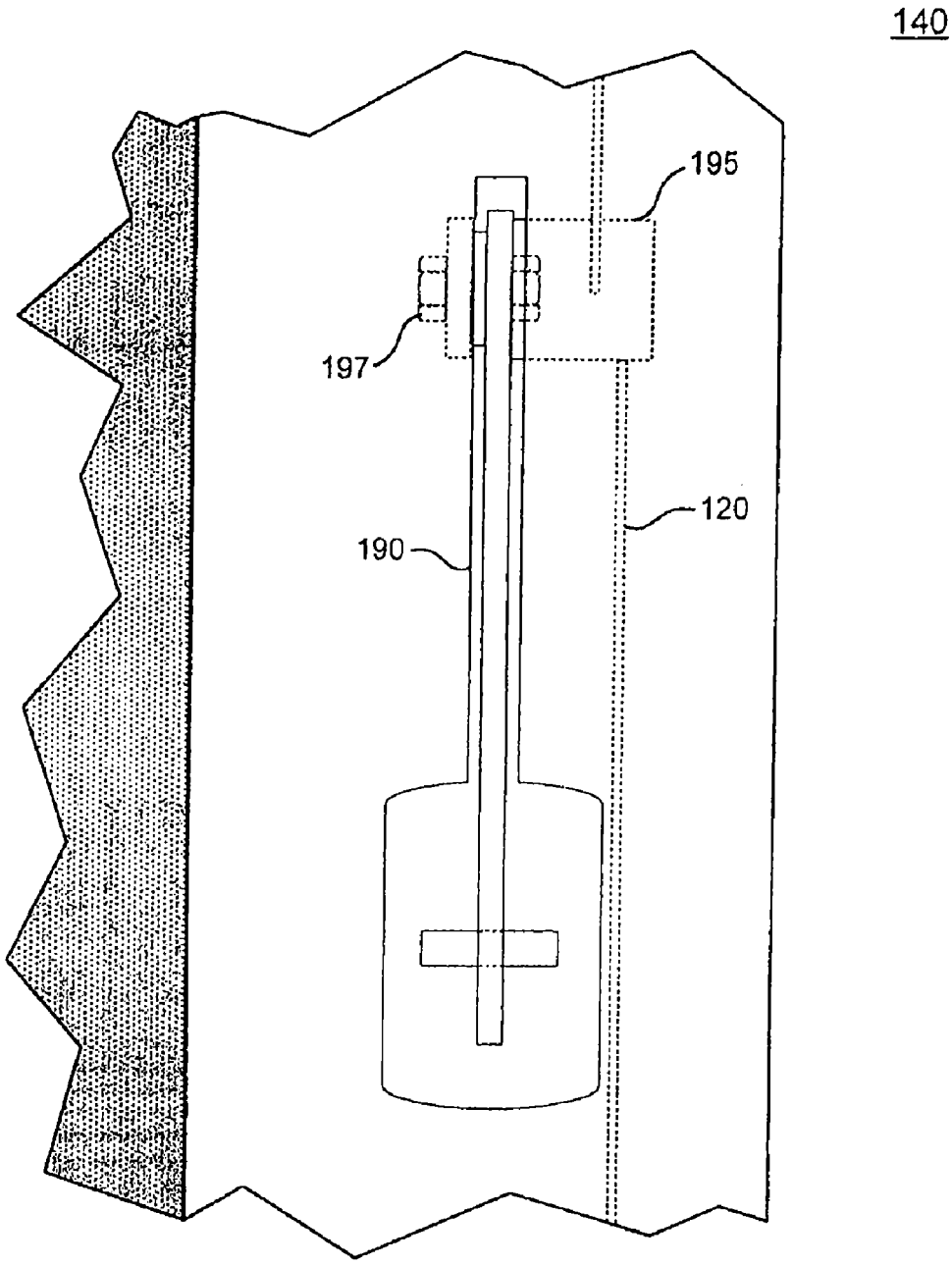
FIG. 11 depicts a left side perspective view of an exemplary embodiment of keeper/cam release lever.

As shown in exemplary embodiments depicted in FIGS. 9-11, release device 140 comprises a release lever 190, a release lever support tab 188, a cable drum 195, and a hex bolt and locking nut 197. Release lever 190 can be attached to the interior side of trailer's 150 doors in one exemplary embodiment or to the interior side of trailer 150 in other exemplary embodiments.

In an exemplary embodiment, release device 140 such as release lever 190 may secured to trailer 150 using any known attachment method, such as screws, bolts, adhesives, welding, and the like. Further, release lever 190 may be secured to rotate perpendicularly away from the body of trailer 150. One end of release lever 190 may be sandwiched between one end of cable drum 195 and release lever support tab 188 and may be secured together using a hex bolt and a locking nut 185. In this exemplary embodiment, release cable 120 may be secured to the cable drum 195 so that when release lever 190 is rotated upward, release cable 120 wraps around cable drum 195 thereby increasing the tension on lock pin return spring 155, and thus retracting the locking pin 115 from the releasable keeper 105 and disengaging releasable keeper 105 from the body of a trailer, thereby permitting egress. Release lever 190 may also be illuminated or otherwise luminescent to enable it to be easily seen in the dark. In other exemplary embodiments, release lever 190 or other similar mechanism may further comprise indicia such as a sticker that reads "emergency exit" or some other wording to alert people inside trailer 150 that release lever 190 is capable of unlocking trailer's 150 doors.

As is shown in an exemplary embodiment in FIG. 9, release lever 190 may be rotated to a downward position, permitting release cable 120 to unwind from the cable drum 195, relaxing tension on the release cable 120 and the lock pin return spring 155 and thereby inserting locking pin 115 into the releasable keeper 105 and securing releasable keeper 105 to the body of trailer 150 for locking the doors.

In other exemplary embodiments, various knobs or other operable devices that are configured to operate release mechanism 110 are used instead of release lever 190 and function as release device 140. Any device now known or developed in the future that enables a person inside trailer 150 to operate release mechanism 110 can be used and fall within the scope of the present invention.

As described above, in some exemplary embodiments releasable door lock 100 comprises release mechanism 110, release cable 120, pulley/guide mechanism 130, and a release device 140, and releasable keeper 105. However, it will be appreciated by one skilled in the art that any method of opening or removably securing a releasable keeper 105 to the body of trailer 150 in such a way that permits a person located inside trailer 150 to open or disengage releasable keeper 105 that is known or hereafter devised may be used.

For example, in an exemplary embodiment, a pneumatic pressure device, optionally having an accumulator, a pneumatic pressure brake system, an integral hand pump, or an independent source of pneumatic pressure may be used to insert and remove lock pin 115 into/from releasable keeper 105 or to otherwise operate release mechanism 110. In other exemplary embodiments, pneumatic valves, rams and actuators, and/or a backup hand pump may be used to operate release mechanism 110.

In another exemplary embodiment, an electrical circuit with servo-relays and/or motors, vehicle or container electrical power, or an independent source of power may be used to insert and remove locking pin 115 into/from releasable keeper 105. Some exemplary embodiments may further comprise an internal emergency reserve battery and a reserve battery charger.

In another exemplary embodiment, hydraulic pressure may be used to insert and remove locking pin 115 into/from releasable keeper 105. Hydraulic pressure may be from a truck or container system, from an independent source, or from an integral hand pump. In other embodiments hydraulic valves, rams, actuators and a backup hand pump may be used.

In another exemplary embodiment, releasable door lock 100 of the present invention may further comprise a disabling mechanism which prevents the activation of the releasable door lock 100 when the cargo container is in motion on a roadway. The motion/speed input may be from a speedometer of trailer 150, from an independent motion/speed sensor, or by sensing when trailer's 150 brakes are disengaged.

In another exemplary embodiment, releasable door lock 100 of the present invention may be adapted for roll-up door latches by installing a detachable release pin or plate on which the latch locks or by releasing the fasteners holding the latch mechanism onto the door.

In an exemplary embodiment, releasable door lock 100 is located on trailer 150. However, it will be appreciated by one skilled in the art that a releasable door lock 100 in accordance with the present invention may be located on any enclosure or structure. Certain exemplary enclosures and structures comprise, but are not limited to, a dry van trailer, a box van, a cargo container, a reefer, a semi-trailer, a large storage locker, a garage, a tractor trailer, and the like.

In an exemplary embodiment, releasable door lock 100 is installed during manufacturing of the enclosure. In another exemplary embodiment, releasable door lock 100 is installed on an existing enclosure that has a locking mechanism by modifying the locking system in accordance with the present invention.

For example, where releasable door lock 100 is installed on trailer 150, an existing keeper may be removed from the body of trailer 150 using any known cutting method, for example, torches may be used. However, it will be appreciated that any method of cutting known or hereinafter devised may be used. Then, a hole large enough to fit lock pin 115 may be then drilled into the keeper that was removed converting it into releasable keeper 105. In another exemplary embodiment, releasable keeper 105 that comprises internal keeper 105A and external keeper 105B is substituted for the keeper that was removed and a hole is drilled in the body of trailer 150 to accommodate a two-piece releasable keeper 105 as discussed above. Release mechanism 110 (i.e. keeper/cam release mechanism), a pulley cable, a pulley/guide mechanism 130, and a release device 140 is then installed on trailer 150 to create releasable door lock 100 of the present invention.

Although the invention has been described herein in conjunction with the appended drawings, those skilled in the art will appreciate that the scope of the invention is not so limited. Modifications in the selection, design, and arrangement of the various components and steps discussed herein may be made without departing from the scope of the invention.

The invention claimed is:

1. A trailer door lock attached to a trailer comprising:

a door locking mechanism located on an exterior side of a body defined by the trailer engaging a releasable keeper attached to the trailer wherein the releasable keeper comprises a removable block that slidingly engages into the body;

a release mechanism connected to the releasable keeper and configured to release the releasable keeper from the trailer to enable the door locking mechanism to be disengaged from the releasable keeper and;

a lock pin return spring coiled around a lock pin and configured to apply pressure to the lock pin to keep the lock pin engaged within the releasable keeper.

2. The trailer door lock attached to a trailer of claim 1, wherein the release mechanism further comprises a pressure applicator in communication with the lock pin.

3. The trailer door lock attached to a trailer of claim 1, wherein the release mechanism is a keeper/cam release mechanism.

4. The trailer door lock attached to a trailer of claim 1, further comprising a release device connected to the release mechanism.

5. The trailer door lock attaching to the trailer of claim 1, wherein the removable block is flush with the body when slidingly engaged to the body.

6. A trailer door lock attached to a trailer comprising:

a door locking mechanism located on an exterior side of a body defined by the trailer engaging a releasable keeper attached to the trailer wherein the releasable keeper comprises a removable block that slidingly engages into the body;

a release mechanism connected to the releasable keeper and configured to release the releasable keeper from the trailer to enable the door locking mechanism to be disengaged from the releasable keeper and;

a release device connected to the releasable keeper by a pulley system.

7. A trailer door lock attached to a trailer comprising:

a releasable keeper comprising a removable block that slidingly engages into a body defined by a trailer;

a door locking mechanism located on the exterior of the trailer engaging the releasable keeper;

a release mechanism connected to the releasable keeper; and a release device connected to the releasable keeper by a pulley system.

8. The trailer door lock attached to a trailer of claim 7, wherein the removable block is flush with the body when slidingly engaged to the body.

9. The trailer door lock attached to the trailer of claim 8, wherein the release mechanism comprises a lock pin engaging the removable block.

10. The trailer door lock attached to a trailer of claim 7, wherein the release mechanism is a keeper/cam release mechanism.

11. A locking system attached to an enclosure with interior and exterior sides defining a body comprising:

a first door locking mechanism located on the exterior side;

a first releasable keeper comprising a removable block slidingly engaging the body and connected to the first door locking mechanism, wherein the removable block is flush with the body when slidingly engaged to the body;

a first release mechanism connected to the first releasable keeper;

a release device located on the interior side connected to the first release mechanism; and a pulley system connecting the release device to the first release mechanism and the second release mechanism.

12. The locking system of claim 11, wherein the first release mechanism is oriented horizontally.

13. The locking system of claim 11,wherein the first release mechanism comprises a lock pin engaging the first releasable keeper.

14. The locking system of claim 11, further comprising a lock pin return spring coiled around the lock pin.

15. The locking system of claim 11, wherein the first release mechanism comprises a keeper/cam system.

16. The locking system of claim 11, wherein the first releasable keeper comprising a removable block and a second releasable keeper comprising a removable block are both rectangular in shape.

17. The locking system of claim 11, further comprising a second door locking mechanism located on the exterior side, a second release mechanism connected to a second releasable keeper comprising a removable block slidingly engaging the body, wherein the release device is connected to the first release mechanism and the second release mechanism and the second releasable keeper comprising a removable block is flush with the body when slidingly engaged to the body.

18. A trailer comprising:

a body with interior and exterior sides;

a door with interior and exterior sides attached to the body;

a releasable keeper comprising a rectangular removable block that slidingly engages the body;

a door locking mechanism attached to the exterior side of the door engaged to the releasable keeper;

a release mechanism connected to the releasable keeper;

a release device connected to the release mechanism; and a pulley system connecting the release device to the release mechanism.

19. The trailer of claim 18, wherein the removable block is rectangular.

20. The trailer of claim 18, wherein the release mechanism comprises a keeper/cam system.

* * * * *